US005383968A

United States Patent [19]

Rantanen et al.

[11] Patent Number: 5,383,968

[45] Date of Patent: Jan. 24, 1995

[54] METHOD AND DEVICE FOR KEEPING A COATING ROD AND A ROD CRADLE IN A BAR COATER CLEAN AND FOR PREVENTING LEAKAGE OF LUBRICATION AND/OR COOLING WATER

[75] Inventors: Rauno Rantanen, Muurame; Markku Lummila; Hannu Korhonen, both of Jyväskylä ; Petri Paloviita, Vantaa; Jukka Koskinen, Helsinki, all of Finland

[73] Assignee: Valmet Paper Machinery Inc., Helsinki, Finland

[21] Appl. No.: 971,321

[22] Filed: Nov. 4, 1992

[30] Foreign Application Priority Data

Nov. 6, 1991 [FI] Finland ..... 915239

[51] Int. Cl.[6] ..... D21H 25/12

[52] U.S. Cl. ..... 118/119; 118/118; 118/414; 118/419; 118/428; 118/262; 118/326

[58] Field of Search ..... 118/119, 118, 414, 419, 118/428, 262, 326

[56] References Cited

U.S. PATENT DOCUMENTS

| | | | |
|---|---|---|---|
| 3,817,208 | 6/1974 | Barnscheidt et al. | 118/119 |
| 4,245,582 | 1/1981 | Alheid et al. | 118/119 |
| 4,367,691 | 1/1983 | Bergs | 118/119 |
| 4,658,753 | 4/1987 | Eklund | 118/119 |
| 5,122,396 | 6/1992 | Rantanen | 427/359 |

FOREIGN PATENT DOCUMENTS

| | | | |
|---|---|---|---|
| 3236991 | 4/1984 | Germany | 118/119 |

*Primary Examiner*—Asok Pal

*Attorney, Agent, or Firm*—Steinberg, Raskin & Davidson

[57] ABSTRACT

A method and device for keeping a coating rod and a rod cradle in a bar coater clean and for preventing leakage of the lubrication and/or cooling water used in the bar coater is disclosed. The invention is intended for a bar coater in which the coating rod is, supported revolvingly in a rod cradle substantially over its entire length. The rod cradle is attached to the frame constructions of the coater. The rod cradle is also provided with at least one groove substantially parallel to the coating rod and open towards said coating rod, in which grooves(s) water is circulated to lubricate, cleanse and/or cool the coating rod and the rod cradle. The coating rod is loaded towards the base to be coated by loading the rod cradle. The rod cradle and the sealing lips of the rod cradle are loaded so that the loading seals the glide faces between the coating rod and the rod cradle substantially over the entire length of the rod cradle and prevents leakage, or at least substantially reduces leakage, from the water grooves.

15 Claims, 4 Drawing Sheets

PRIOR ART

FIG. A1

METHOD AND DEVICE FOR KEEPING A COATING ROD AND A ROD CRADLE IN A BAR COATER CLEAN AND FOR PREVENTING LEAKAGE OF LUBRICATION AND/OR COOLING WATER

BACKGROUND OF THE INVENTION

The invention relates to a method for keeping a coating rod and a rod cradle in a bar coater clean. The method also relates to preventing leakage of the lubrication and/or cooling water in the bar coater. In the bar coater, the coating rod is supported revolvingly substantially over its entire length in the rod cradle attached to the frame constructions of the coater. The cradle is provided with at least one groove substantially parallel to the coating rod and open towards the coating rod. In the groove(s), water is circulated to lubricate, cleanse and/or cool the coating rod and the rod cradle. The coating rod is loaded towards a base to be coated by loading the rod cradle.

The invention also relates to a device for carrying out the method in accordance with the invention. The device is arranged for keeping the cradle of the coating rod in the bar coater clean and for preventing leakage of the lubrication and/or cooling water in the bar coater. In the bar coater, the coating rod is supported revolvingly substantially over its entire length in a rod cradle attached to the frame construction of the coater. The cradle is provided with at least one water groove substantially parallel to, and open towards, the coating rod. In the groove(s), water circulation is arranged to lubricate, to cleanse and/or cool the coating rod. The rod cradle is provided with means for loading the coating rod towards the base to be coated.

FIELD OF THE INVENTION

Bar coaters are commonly used in connection with size presses of paper machines to meter and spread the size onto the faces of the size-press rolls. Further, bar coaters are used for the coating of paper, especially in cases in which it is feared that the coating blade of a blade coater produces streaks in the paper face.

By means of a coating rod, attempts are made to avoid these streaks so that the rod is generally rotated in the direction opposite to the running direction of the web. Generally, the rod rotates at a speed from about 10 to about 600 revolutions per minute. For this reason, the coating bars are provided with a suitable drive gear to rotate the rod. In wide machines, the rods are usually provided with drives at both ends to avoid torsional oscillations.

When a bar coater is used, the coating process can be performed, e.g., so that the coating agent is applied to the web face by means of an applicator roll, and any excessive coating agent can be scraped off the web face by means of the coating rod. A bar coater may also be constructed as a so-called short-dwell unit, in which the coating agent is passed into a coating-agent chamber, which is defined by the front wall of the chamber, the coating bar and the base to be coated. The base to be coated may be a paper web or equivalent and, in particular in size-press applications, the face of a backup roll.

The coating rod is generally mounted revolvingly in a cradle made of a suitable material, such as polyurethane. The rod is normally supported in the cradle over its entire length. In the cradle, in connection with the rod, at least one water groove, and often two grooves are provided. The water circulated in the grooves lubricates, cleanses and cools the coating rod. However, a substantial problem in the bar coaters is leakage of the water present in the water grooves, for example, when the groove is blocked by size or by pigment coating paste or when the rod cradle is worn. When a leakage of water occurs, the cooling, washing and lubricating effect of the water is reduced and, at the same time, water penetrates onto the base to be coated.

With respect to the prior art, reference is made, in particular, to FIG. A1, which illustrates a conventional coater, which is denoted generally with the reference numeral 10. The coater 10 is a bar coater, whose coating rod 13 is, in the embodiment shown in FIG. A1, fitted against the paper or board web W that runs on the face of a backup roll 14. The coater 10 shown in FIG. A1 is a coater of the so-called short-dwell type, wherein the coating agent is brought into an application zone 11 placed before the coating rod 13, in the running direction of the web W. The application zone 11 is defined by the coating rod 13, and also by the web W, by a front wall 12 of the application zone, and by lateral seals (not shown). The application zone 11 is ordinarily pressurized. From the application zone 11, an overflow of the coating agent is arranged through a gap 15 between the front wall of the application zone and the web W.

In the prior art device, the coating rod 13 is fitted in a cradle 18, which is made of a suitable material, such as polyurethane. The cradle 18 supports the coating rod 13 over its entire length. The coating rod 13 is provided with a dedicated drive, by whose means the coating bar 13 is rotated in the direction opposite to the running direction of the web W. The cradle 18 of the coating rod 13 is fitted in a support 16, and both the cradle 18 and the support 16 are together attached to a holder 19 mounted on the frame of the coater 10. Moreover, a loading hose 17 is provided behind the cradle 18, on the support 16. By means of the loading hose 17, the coating bar 13 can be loaded in the desired way against the web W. A water groove 5 has been formed into the cradle 18 that connects with the coating rod 13. The water, circulating in the grooves, lubricates, cleanses, and cools the coating bar 13 and the cradle 18.

A problem in the prior art coater described above has been leakage of the cooling water out of the water groove 5. The problem is severe in particular when the water groove 5 is blocked or when it is necessary to increase the pressure in the loading hose 17 to obtain the desired coating result. Generally, it might be assumed that when the pressure in the loading hose 17 is increased, the lips 6 and 7 of the cradle 18 placed against the coating rod 13 are pressed more tightly against the coating rod 13. However, the result has frequently been that the lower sealing lip 6 has been bent and at least partly opened so that water has been able to leak out of the water groove 6 between the sealing lip 6 and the coating bar 13. In the prior art solutions, it has not been possible to solve this problem, because, in coaters shown in FIG. A1, the only possibility to eliminate the problem of leakage, in particular during running of the machine, would be to regulate the pressure in the loading hose 17. However, this can not be done, because it would have considerable detrimental significance for the coating result.

OBJECTS AND SUMMARY OF THE INVENTION

An object of the present invention is to provide a method and a device by whose means the drawbacks related to the prior art solutions are avoided. In view of accomplishing this, the method in accordance with the invention is mainly characterized in that the rod cradle and the sealing lips of the rod cradle are loaded so that the loading seals the glide faces between the coating rod and the rod cradle substantially over the entire length of the rod cradle substantially reduces leakage from the water grooves.

The device in accordance with the invention is mainly characterized in that the means for loading the coating rod and the rod cradle comprise one or several loading members that extend substantially over the entire length of the rod cradle. The loading produced by means of the loading members is arranged to seal the glide faces between the coating rod and the rod cradle and to prevent leakage, or at least to substantially reduce leakage from the water grooves.

An important advantage of the present invention, as compared with the prior art solutions is the achieving of the afore-mentioned objectives. In particular, it is an object of the invention to prevent water from leaking out of the water groove in the cradle of the coating rod onto the base to be coated. Another object is to prevent the water groove from becoming blocked, such that the water does not leak out of the water groove but flows through the water groove in the intended way. In this way, disturbances of the operation of the machine arising from the leakages of water do not occur. Thus, by means of the present invention, it is possible to avoid the production interruptions that occur in the prior art solutions. The other advantages and characteristic features of the invention come out from the following detailed description of the invention.

BRIEF DESCRIPTION OF THE DRAWINGS

The following drawings are illustrative of embodiments of the invention and are not meant to limit the scope of the invention as encompassed by the claims.

FIG. A1 is an illustration of a conventional prior art bar coater.

DETAILED DESCRIPTION OF THE PREFERRED EMBODIMENTS

Figure 1:
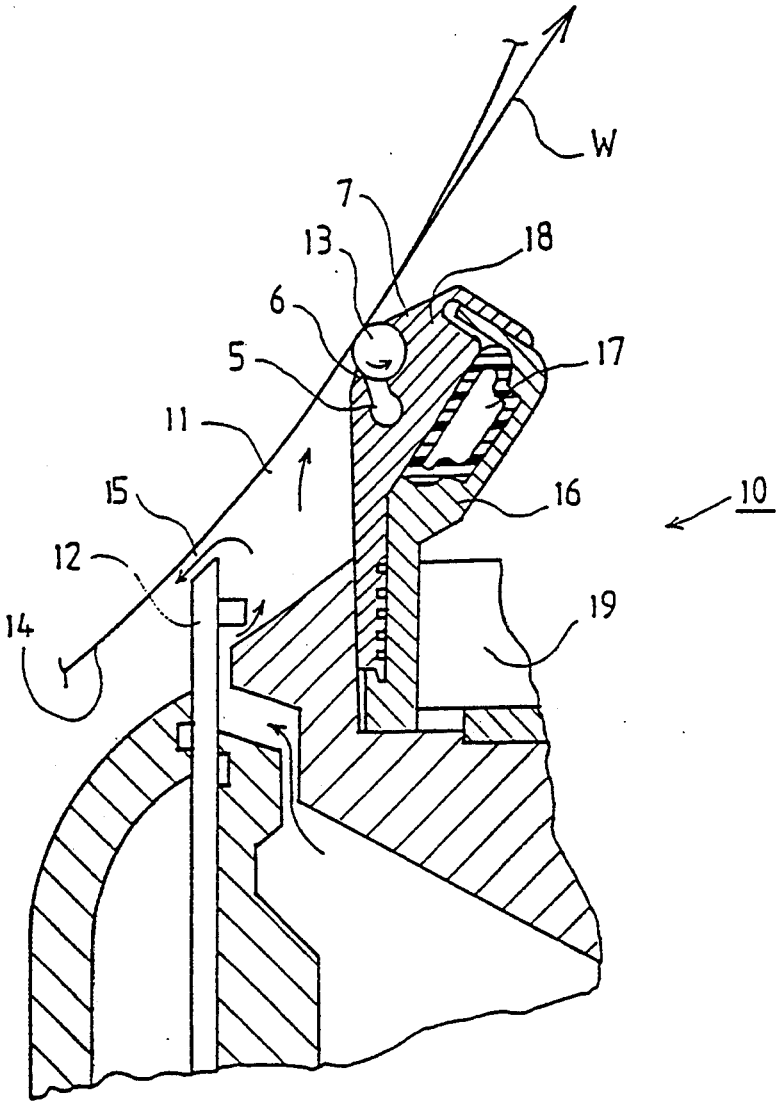
FIG. 1 is a schematic sectional side view of an embodiment of a coating rod construction in accordance with the invention.

In FIG. 1, the construction of the coating rod is denoted generally with the reference numeral 20. The coating rod construction 20 comprises a coating rod 21 mounted revolvingly in a cradle 22 and supported against a base B to be coated. The base to be coated may be a paper or board web, the face of a backup roll, or the face of a size-press roll.

In the embodiment of FIG. 1, two grooves 23 and 24 have been formed into the cradle 22 of the coating rod and are connected to the coating rod 21. At least one of the grooves is provided with water circulation, which lubricates, cleanses, and cools the coating rod 21 and the cradle 22. The cradle 22 of the coating rod is fitted on a support 30. The support 30 and the cradle of the coating rod are attached to a holder (not shown) placed on the frame of the coater.

A first loading hose 31 or an equivalent loading member is fitted between the coating rod cradle 22 and the support 30. The loading hose 31 rests against the rear face 29 of the cradle, which operates as a support face. The pressure of the coating rod 21 against the base B to be coated is regulated by adjusting the pressure in the loading hose 31. Glide faces 26 and 28 have been formed onto the sealing lips 25 and 27 of the cradle 22. Glide faces 26 and 28 are in glide contact with the coating rod 21 and are sealed so that the water circulating in the groove/grooves 24 and/or 23 cannot leak through the contact area.

Referring to the embodiment shown in FIG. 1, a groove 32 has been formed in the transverse direction of the machine into a rear face 29 of the coating rod cradle 22. A second loading member 33, e.g. a loading hose as shown in FIG. 1, is fitted into the groove 32. When the pressure in the second loading hose 33 is increased, the glide faces 26 and 28 of the sealing lips 25 and 27 can be pressed more tightly against the coating rod 21. In this manner, leakage of water out of the grooves 23 and 24 is efficiently prevented through the contact areas between said glide faces 26 and 28 and the coating rod 21.

As can be seen from FIG. 1, the first loading hose 31 and the second loading hose 33 are separate from one another. Therefore, a change in the pressure in one loading hose 33 does not affect the loading of the coating rod 21, but will only affect the tightness of the contact between the sealing lips 25 and 27 and the coating rod 21. Thus, in the solution in accordance with the present invention, an increased tightness of contact has no detrimental effect on the coating result.

In the solution as shown in FIG. 1, the direction of loading hose 31 is substantially perpendicular to the rear face 29 of the cradle. By means of only the first loading hose 31, the compression of the coating rod 21 against the base B to be coated is regulated.

The primary direction of loading of the second loading hose 33 is parallel to the rear face 29 of the cradle. By the effect of the second loading hose 33, the sealing lips 25 and 27 tend to be turned more tightly against the coating rod 21. Several loading hoses can be employed for regulating the tightness of the sealing lips 25 and 27. The several loading hoses are similar to the second loading member 33 and are placed in corresponding grooves in the rear face 29 of the cradle. However, it has been noted that the desired effect is obtained by means of a construction as shown in FIG. 1, wherein only one loading hose 33 is used for regulation of the tightness of the sealing lips 25 and 27.

Figure 2:
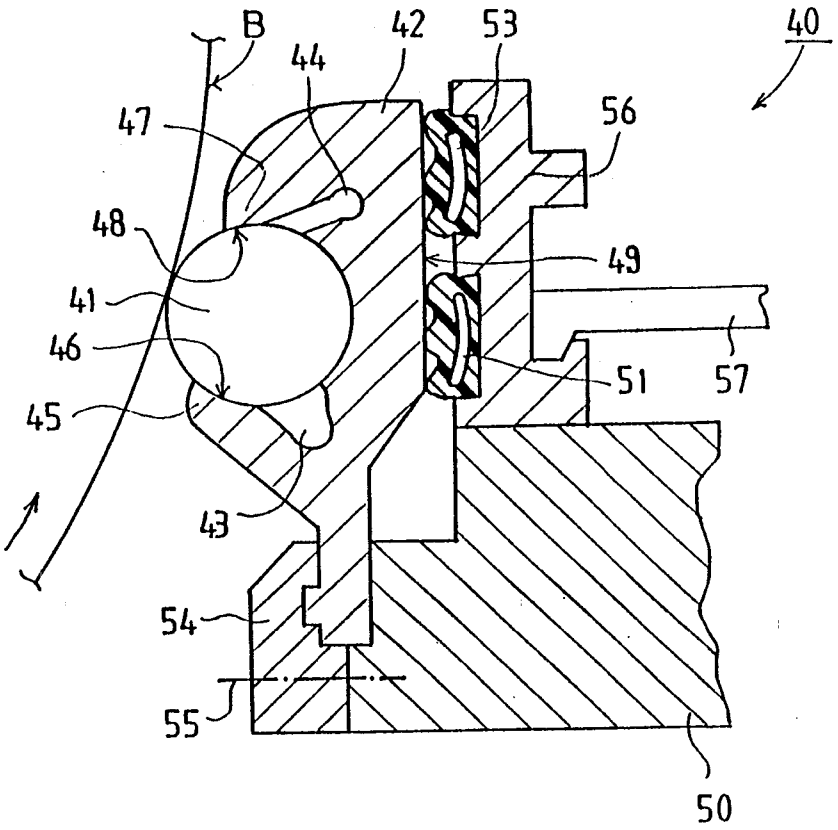
FIG. 2 is an illustration similar to FIG. 1 showing a second embodiment of a coating rod construction in accordance with the invention.
Figure 1:
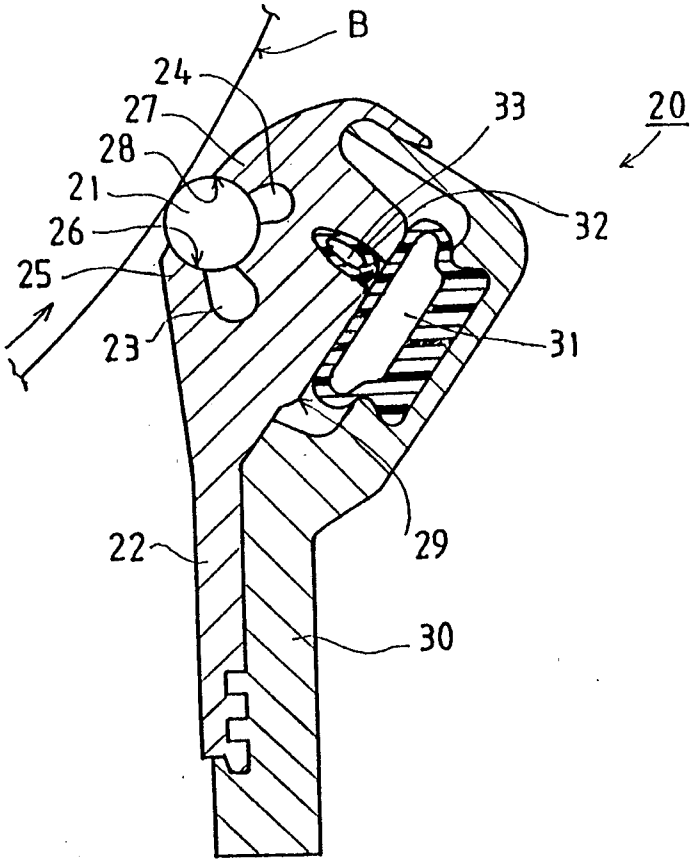

FIG. 2 shows a second embodiment of the method and device in accordance with the invention. In FIG. 2, the coating rod construction is denoted generally with the reference numeral 40. The coating rod construction 40 comprises a coating rod 41, which is mounted revolvingly in the cradle 42 of the coating rod and is loaded against the base B to be coated. Grooves 43 and 44 have been formed into the cradle 42, in a way corresponding to that shown in FIG. 1. Water circulates in at least one of the water grooves to lubricate, cleanse, and cool the coating rod 41 and the rod cradle 42. The cradle 42 further comprises sealing lips 45 and 47. Glide faces 46 and 48 are formed on the lips and are in a sealing contact with the coating rod 41, thus preventing leakage of water out of the grooves 43 and 44.

In the embodiment shown in FIG. 2, the cradle 42 is mounted on a support 50, to which it is attached by means of a holder 54 and fastening members 55. The embodiment shown in FIG. 2 further includes a profile rib 56, which can be shifted towards and away from the base B to be coated by means of adjusting spindles 57. A number of spindles are arranged at a distance from one another in the transverse direction of the machine.

The profile rib 56 can be deflected as desired, by pushing and/or pulling the profile rib 56 by means of the adjusting spindles 57. In this manner, the profile of the coating rod construction 40 can be adjusted in the desired way.

In the embodiment shown in FIG. 2, two loading members have been fitted on the profile rib 56, e.g. loading hoses 51 and 53. The loading hoses 51, 53 rest against the rear face 49 of the cradle which operates as the support face. As is shown in FIG. 2, the loading hoses 51 and 53 act upon the rear face 49 of the cradle at different points, so that the point of effect of the first loading hose 51 is substantially at the level of the coating rod 41. The point of effect of the second loading hose 53 is placed aside from said rod. Thus, by means of the first loading hose 51, the loading of the coating rod 41 against the base B to be coated is regulated. By means of the second loading hose 53, the cradle is deflected so that the glide faces 46 and 48 of the sealing lips 45 and 47 are pressed more tightly against the coating rod 41.

In the embodiment as shown in FIG. 2, it may be desirable to increase the tightness of the contact of the sealing lips 45 and 47 against the coating rod 41. However, an increase in the pressure in the second loading hose 53 also increases the pressure of the coating rod 41 against the base B to be coated. Therefore, when the tightness of the sealing lips 45 and 47 is increased, the pressure in the first loading hose 51 must be lowered so that the loading pressure of the coating rod 41 will not be increased. Thus, the loading hoses 51 and 53 are completely separate from one another and separately adjustable, as in the embodiment shown in FIG. 1.

Figure 3:
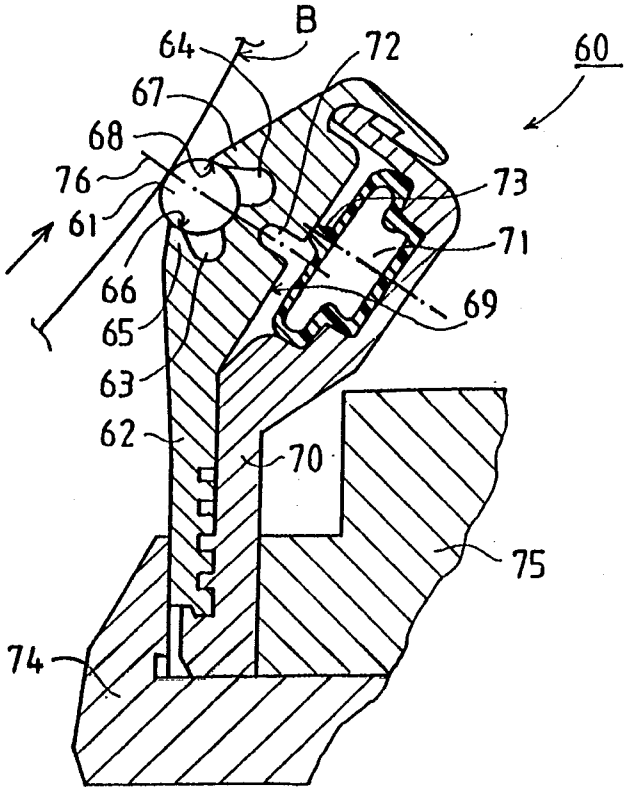
FIG. 3 is an illustration similar to FIGS. 1 and 2 showing a third embodiment of a coating rod construction in accordance with the invention.

In the embodiment shown in FIG. 3, the coating rod construction is denoted generally with the reference numeral 60. The coating rod construction 60 comprises a coating rod 61, which is fitted in a cradle 62. The cradle 62 supports the coating rod 61 over its entire length. The coating rod 61 is loaded against the base B to be coated in a way corresponding to the embodiments described above. The cradle 62 of the coating rod is fitted in a support 70. The support 70 and the cradle 62 are mounted on a frame 75 of the coater by means of a holder 74.

Also in the embodiment of FIG. 3, two grooves 63 and 64 transverse to the machine direction have been formed into the cradle 62 of the coating rod. The grooves 63 and 64 are open towards the coating rod 61. In at least one of the grooves 63, 64, circulation of water has been provided to lubricate, cleanse, and cool the coating rod 61 and the rod cradle 62.

In a corresponding way, glide faces 66 and 68 have been formed onto sealing lips 65 and 67 of the cradle. Glide faces 66 and 68 rest against the coating rod 61 and prevent leakage of water out of the water groove(s) 63 and/or 64. On the support 70, a loading hose 71 or an equivalent loading member is mounted. The rear face 69 of the cradle is loaded by means of the pressure prevailing in the loading hose 71, or equivalent, in order to regulate the loading pressure between the coating rod 61 and the base B to be coated.

In the embodiment shown in FIG. 3, a groove 72 has been formed into the rear face 69 of the coating rod cradle in the transverse direction of the machine. The groove 72 has been arranged, e.g., in the way shown in FIG. 3, substantially on the contact line 76 between the coating rod 61 and the base B to be coated. The purpose of the groove 72 is to reduce the rigidity of the cradle 62 of the coating rod so that the cradle 62 can be deflected more readily by means of the loading hose 71.

In a corresponding way, a ridge has been formed onto the loading hose in the transverse direction of the machine. The loading hose 71 contacts the rear face 69 of the cradle substantially and exclusively by the intermediate of the ridge 73. According to FIG. 3, the ridge 73 is placed aside from the contact line 76 between the coating rod 61 and the base B to be coated, towards the second sealing lip 67. Thus, when the pressure in the loading hose 71 is raised, the load produced by the loading hose 71 on the rear face 69 of the cradle attempts to deflect the cradle 62. At the same time, the load attempts to increase the tightness of the sealing lips 65 and 67 against the coating rod 61 and to prevent any leakage out of the water groove(s) 63 and/or 64 more efficiently.

A difference in the embodiment as shown in FIG. 3, as compared with the constructions shown in FIGS. 1 and 2, is, that, when the tightness of the contact of the sealing lips 65 and 67 is increased, the loading pressure between the coating rod 61 and the base B to be coated is, at the same time, also increased. Thus, in the embodiment of FIG. 3, the regulation of the tightness of the sealing lips 65 and 67 depends on the loading pressure between the coating rod 61 and the base B to be coated, and vice versa.

In respect of FIG. 3, it can be ascertained that, in this embodiment, the tightness of the sealing lips 65 and 67 can be regulated during operation, as in the case in the preceding embodiments. The method is well suited for use when the loading pressure of the coating rod 61 is not regulated within wide limits, but the coating quantity is regulated, e.g., by adjusting the dry solids content of the coating agent.

Figure 4:
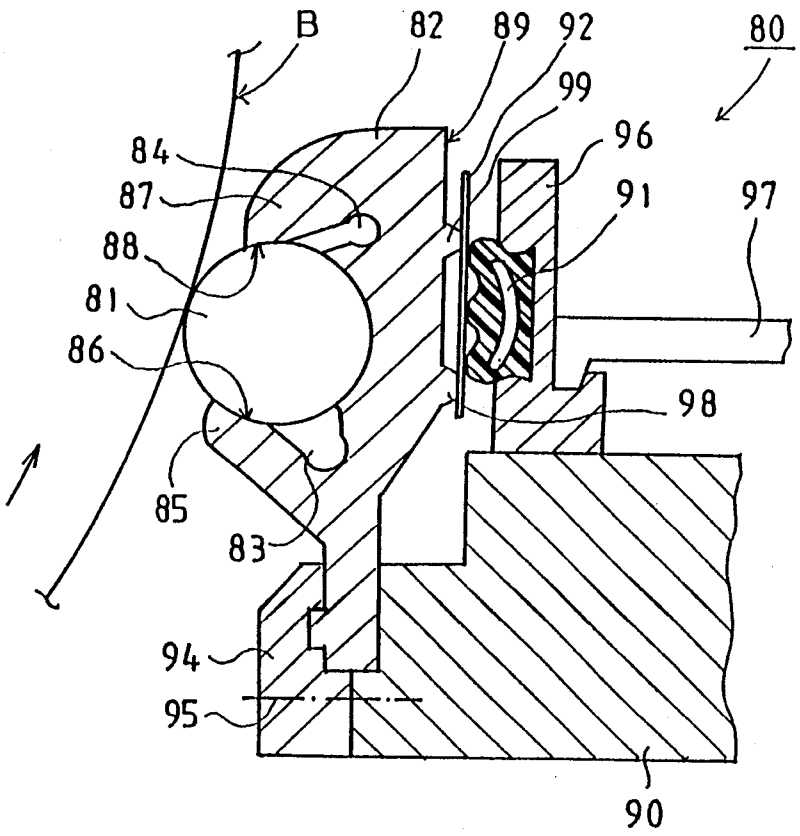
FIG. 4 is an illustration similar to FIGS. 1–3 showing a fourth embodiment of a coating rod construction in accordance with the invention.

In the embodiment shown in FIG. 4, the coating rod construction is denoted generally with the reference numeral 80. The coating rod construction 80 comprises a coating rod 81, which is mounted revolvingly in a coating rod cradle 82 and loaded against a base B to be coated. In a way corresponding to FIG. 2, in the embodiment shown in FIG. 4, grooves 83, 84 have been formed into the cradle 82 of the coating rod. The grooves 83, 84 are open towards the coating rod 81 and are placed in the transverse direction of the machine. In at least one of the grooves, water circulates to lubricate, cleanse, and cool the coating rod 81.

The cradle 82 further comprises sealing lips 85 and 87, which are supported against the coating rod 81 by the intermediate of the glide faces 86 and 88. The cradle 82 is mounted on a support 90, to which it is attached by the intermediate of a holder 94 and fastening members 95. In a way corresponding to FIG. 2, the rod construction 80 comprises a profile rib 96, which can be shifted by means of adjusting spindles 97 towards the base B to be coated. By means of the adjusting spindles 97, the profile rib 96 can also be deflected, as was previously described in relation to FIG. 2.

The embodiment of FIG. 4 differs from the embodiment of FIG. 2, in that only one loading hose 91, or an equivalent loading member mounted on the profile rib 96, is used. Two ridges 98 and 99 have been formed onto the rear face 89 of the cradle 82 in the transverse direction of the machine, which ridges are placed at a distance from one another. The ridges 98, 99 are fitted in such a way that at least one ridge 99 is placed clearly aside from the contact line between the coating rod 81 and the base B to be coated, toward the second sealing lip 87.

Moreover, a plate 92 is arranged between the loading hose 91 and the ridges 98, 99. The load produced by the loading hose 91 is transferred to the rod cradle 82 by the intermediate of the plate 92 at two different points, i.e. exactly at the ridges 98, 99. As the load is applied to the rod cradle 82 at two different points, these loads attempt to bend the rod cradle 82 in a way corresponding to that described in connection with FIG. 2, in which the rod cradle was loaded by means of two separate loading hoses. Thus, when the pressure in the loading hose 91 is increased the tightness of the sealing lips 85, 87 against the coating rod 81 is increased at the same time.

As compared with the constructions as shown in FIGS. 1 and 2, the embodiment of FIG. 4 has the same differences as the embodiment shown in FIG. 3 has, i.e. that an increase in the tightness of the sealing lips 85, 87 increases the loading pressure of the rod 81 at the same time. Thus, in the case of FIG. 4, the regulation of the tightness of the sealing lips 85, 87 is fully dependent on the loading produced means of the loading hose 91.

Figure 5:
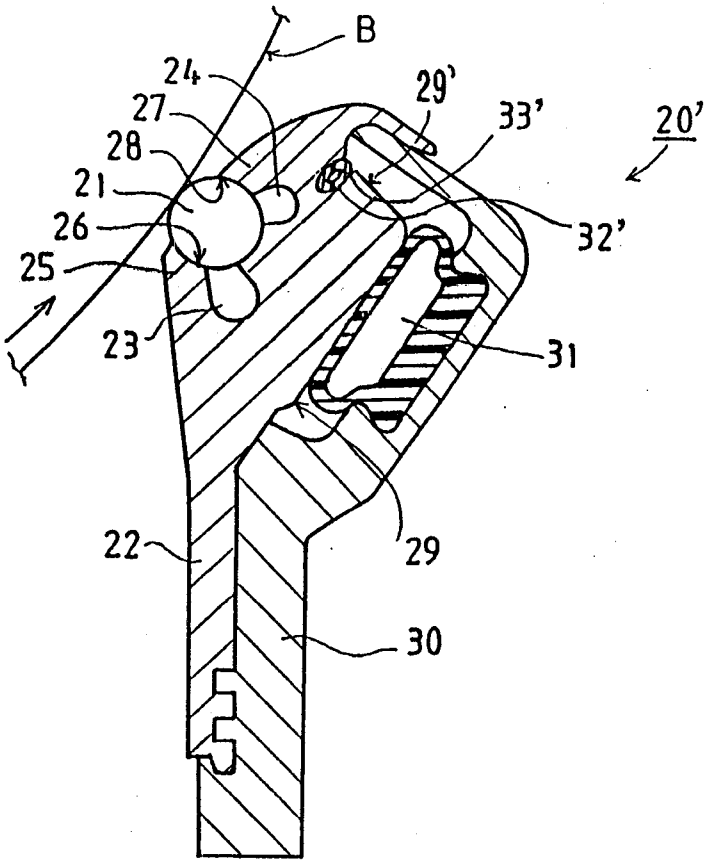
FIG. 5 is an illustration similar to FIGS. 1–4 showing a fifth embodiment of a coating rod construction in accordance with the invention.

The embodiment of the coating rod construction in accordance with the invention shown in FIG. 5 corresponds to the solution illustrated in FIG. 1. In FIG. 5 the coating rod construction is denoted generally with the reference numeral 20'. Thus, in FIG. 1, for the parts corresponding to FIG. 1, the same reference numerals are used, and in this respect, reference is made to the description related to FIG. 1. In the following, FIG. 5 will be described in the respects only in which it differs from the embodiment of FIG. 1.

Whereas in the embodiment of FIG. 1, the groove 32 intended for the second loading member 33 is formed into the rear face 29 of the rod cradle, in the embodiment of FIG. 5 the corresponding groove 32' is formed into the rod cradle 22 at a side 29' placed next to the second groove 24, which is open towards the coating rod 21, or into a corresponding outside face. The second loading member, e.g. a loading hose as shown in FIG. 5, is denoted with the reference numeral 33'. The effect produced by means of the second loading member 33' is similar to that produced in the embodiment as shown in FIG. 1. The principal loading direction of the second loading member 33' differs from the construction shown in FIG. 1, so that said loading direction is substantially parallel to the face 29'.

The purpose of the illustration of FIG. 5 has been to illustrate the fact that the location of the second loading member 33' in the rod cradle 22 can be chosen quite freely, because, owing to the material of the rod cradle 22 (e.g. polyurethane or equivalent), the same effect can be achieved by means of a number of different alternative locations. As one alternative embodiment, it would even be possible to envision an embodiment in which the rod cradle 22 is provided both with a loading member in accordance with FIG. 1 and with a loading member 33' in accordance with FIG. 5. However, as was already explained above, the desired effect can be obtained by means of one loading hose 33' or 33, respectively, that regulates the tightness of the sealing lips 25 and 27.

Figure 6:
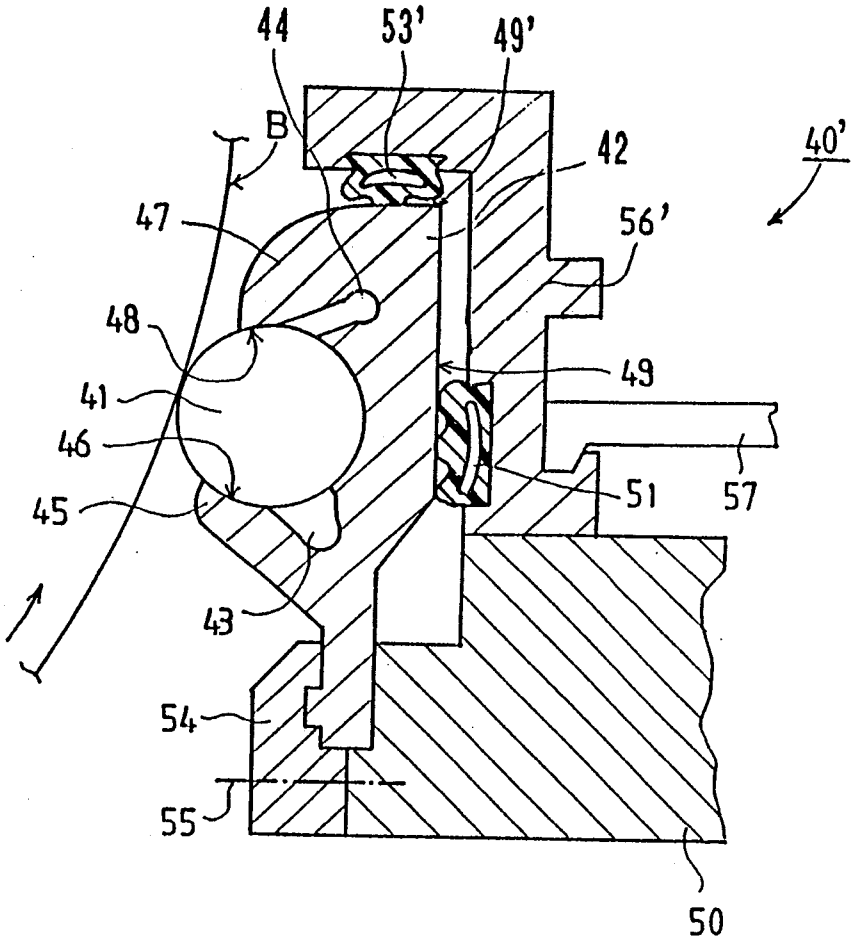
FIG. 6 is an illustration similar to FIGS. 1–5 showing a further exemplifying embodiment of a coating rod construction in accordance with the invention.

The embodiment of the invention shown in FIG. 6 is quite extensively similar to that illustrated earlier in FIG. 2. In FIG. 6, the coating rod construction is denoted generally with the reference numeral 40'. For the parts that correspond to FIG. 2, the same reference notations are used in FIG. 6 and in their respect, reference is made to the detailed description of FIG. 2. In the following, FIG. 6 will be described in the respects only in which it differs from the embodiment shown in FIG. 2.

In the embodiment of FIG. 2, two loading members 51 and 53 had been arranged as acting upon the rear face 49 of the rod cradle, of which members the first loading member 51 was mainly used for regulation of the loading pressure of the coating rod 41. The second loading member 53 was used for regulation of the tightness of pressing of the glide faces 46 and 48 of the sealing lips 45 and 47 against the coating rod 41.

In the embodiment shown in FIG. 6, profile rib 56' has been modified so that it extends over the rod cradle 42. The second loading member 53 is fitted on the profile rib 56' so that it acts upon a top face 49' of the rod cradle 42. In the embodiment of FIG. 6, the same effect is produced as by means of the solution shown in FIG. 2, yet, with the exception that an increase in the loading level of the second loading member 56' does not have a substantial effect on the loading pressure of the coating rod 41. In the embodiment of FIG. 6, the loading levels of the first and the second loading member 51, 53' do not have an effect on each other similar to that present in the solution of FIG. 2.

In the description given above, it has been ascertained in relation to the figures in the drawing that the loading hoses are attached to a support (cf. FIGS. 1, 3 and 5) or to a profile rib (cf. FIGS. 2, 4 and 6), from which they are supported against the rod cradle itself. The arrangement may, of course, also be the opposite, so that the loading hoses are attached to the rod cradle itself, from which they are supported against the support or against the profile rib, respectively.

In the above description, different embodiments of bar coaters have been described, which bar coaters, referred to solutions in which a conventional coating rod of quite a small diameter, generally of an order of 10 mm, was employed. As regards the present invention, it should be noted that the solution of the invention is also suitable for use in the cases in which the diameter of the coating rod is considerably larger, e.g. of an order of 35 mm. Recently, it has been noticed that rods of large diameter have certain advantages over conventional coating rods. Further, in the solution in accordance with the invention, it is possible to use either a fully smooth rod or a grooved rod.

The examples provided above are not meant to be exclusive. Many other variations of the present invention would be obvious to those skilled in the art, and are contemplated to be within the scope of the appended claims.

What is claimed is:

1. A device for keeping a cradle of a coating rod in a bar coater clean and for preventing leakage of lubrication and/or cooling water in the bar coater, comprising:

a rod cradle, a coating rod revolvingly supported substantially over its entire length in said rod cradle, a frame construction for a bar coater, said rod cradle being attached to said frame construction, at least one water groove arranged in said rod cradle substantially parallel to and open towards said coating rod, said groove being structured and arranged to circulate water which lubricates, cleanses and/or cools said coating rod, loading means for loading said coating rod and said rod cradle towards a base to be coated, said loading means comprise a loading member that extends substantially over the entire length of said rod cradle, said loading member being arranged to seal glide faces arranged between said coating rod and said rod cradle and prevent leakage of water from said groove, said loading member acting against a rear face of said rod cradle, and a second groove formed in said rear face of said rod cradle, said second groove being parallel to a longitudinal direction of said rod cradle, said loading member being structured and arranged to provide a substantially linear load a distance from said second groove to thereby load said rear face of said rod cradle.

2. A device as claimed in claim 1, wherein said loading member is attached to said frame construction.

3. A device as claimed in claim 1, wherein said loading member is attached to said rod cradle.

4. The device of claim 1, wherein said second groove is formed on a line of contact between said coating rod and the base to be coated, said loading member further comprising a ridge which contacts the rear face of said rod cradle.

5. A device for keeping a cradle of a coating rod in a bar coater clean and for preventing leakage of lubrication and/or cooling water in the bar coater, comprising:

a rod cradle, a coating rod revolvingly supported substantially over its entire length in said rod cradle, a frame construction for a bar coater, said rod cradle being attached to said frame construction, at least one water groove arranged in said rod cradle substantially parallel to and open towards said coating rod, said groove being structured and arranged to circulate water which lubricates, cleanses and/or cools said coating rod, and loading means for loading said coating rod and said rod cradle towards a base to be coated, said loading means comprising first and second loading members that extend substantially over the entire length of said rod cradle, said first loading member structured and arranged to adjustably load said coating rod, said second loading member structured and arranged to regulate the tightness of glide faces arranged between said coating rod and said rod cradle independently from the loading pressure applied by said first loading member and prevent leakage of water from said groove, said first loading member and said second loading member being arranged at a distance from one another and to act against a rear face of said rod cradle.

6. The device of claim 5, wherein said first and second loading members are attached to said frame construction.

7. A device for keeping a cradle of a coating rod in a bar coater clean and for preventing leakage of lubrication and/or cooling water in the bar coater, comprising:

a rod cradle, a coating rod revolvingly supported substantially over its entire length in said rod cradle, a frame construction for a bar coater, said rod cradle being attached to said frame construction, at least one water groove arranged in said rod cradle substantially parallel to and open towards said coating rod, said groove being structured and arranged to circulate water which lubricates, cleanses and/or cools said coating rod, and loading means for loading said coating rod and said rod cradle towards a base to be coated, said loading means comprising first and second loading members that extend substantially over the entire length of said rod cradle, said first loading member structured and arranged to adjustably load a rear face of said coating rod adjustably against the base to be coated, and a second groove formed in said rear face of said rod cradle, said second groove being parallel to a longitudinal direction of said rod cradle, said second loading member being arranged in said second groove to regulating the tightness of glide faces arranged between said coating rod and said rod cradle independently from pressure applied by said first loading member and prevent leakage of water from said groove.

8. The device of claim 7, wherein said second loading member expands in said second groove and causes said seal glide faces to be pressed tightly against said coating rod.

9. The device of claim 7, wherein said first loading member is attached to said frame construction.

10. The device of claim 7, wherein said second loading member is attached to said rod cradle.

11. A device for keeping a cradle of a coating rod in a bar coater clean and for preventing leakage of lubrication and/or cooling water in the bar coater, comprising:

a rod cradle, a coating rod revolvingly supported substantially over its entire length in said rod cradle, a frame construction for a bar coater, said rod cradle being attached to said frame construction, at least one water groove arranged in said rod cradle substantially parallel to and open towards said coating rod, said groove being structured and arranged to circulate water which lubricates, cleanses and/or cools said coating rod, loading means for loading said coating rod and said rod cradle towards a base to be coated, said loading means comprising a loading member that extends substantially over the entire length of said rod cradle, said loading member being arranged to seal glide faces arranged between said coating rod and said rod cradle and to prevent leakage from said groove, longitudinal ridges formed onto a rear face of said rod cradle, said ridges being formed at a distance from one another and parallel to the longitudinal direction of said rod cradle, and a plate arranged between said loading member and said ridges so that a load is transferred from said loading member to said ridges by said plate.

12. The device of claim 11, further comprising two longitudinal ridges arranged at a distance from one another, said loading member being structured and arranged to load said rear face of said rod cradle by means of two substantially linear loads applied to said ridges.

13. The device of claim 12, wherein a first one of said longitudinal ridges is arranged aside from a line of contact between said coating rod and the base to be coated.

14. The device of claim 11, wherein said loading member is attached to said frame construction.

15. The device of claim 11, wherein said loading member is attached to said rod cradle.

* * * * *